United States Patent [19]

Bruner, Jr.

[11] Patent Number: 4,799,683

[45] Date of Patent: Jan. 24, 1989

[54] INTERACTIVE VIDEO GAME OF CHANCE AND PLAYER CONTROLLED SUBSYSTEM THEREFOR

[75] Inventor: George M. Bruner, Jr., Willow Grove, Pa.

[73] Assignee: Tekbilt, Inc., Oreland, Pa.

[21] Appl. No.: 908,049

[22] Filed: Sep. 16, 1986

[51] Int. Cl.[4] ..... A63F 9/00

[52] U.S. Cl. ..... 273/138 A; 273/1 E; 273/85 CP; 273/DIG. 28

[58] Field of Search ..... 273/138 A, 85 CP, DIG. 28, 273/1 E, 85 G; 340/825.68

[56] References Cited

U.S. PATENT DOCUMENTS 3,909,002 9/1975 Levy ..... 273/138 A
4,242,664 12/1980 Lindstedt et al. ..... 3340/825.68
4,352,492 10/1982 Smith ..... 273/DIG. 28
4,375,581 3/1983 Jayant ..... 371/31
4,467,424 8/1984 Hedges et al. ..... 273/138 A

*Primary Examiner*—Maryann Lastova
*Attorney, Agent, or Firm*—Woodcock Washburn Kurtz Mackiewicz & Norris

[57] ABSTRACT

A remote control system for playing a game upon a color television receiver, such that a broadcast received by the receiver may be viewed interchangeably with the game each without interference to the other, includes a supervisory transmitter to control viewing selection and a player transmitter to play the game. Infrared signals from the transmitters command a solid-state game board through an infrared receiver and decoder, with signals from the game board being output to a transfer unit which bypasses the television receiver's composite sync signal.

3 Claims, 5 Drawing Sheets

INTERACTIVE VIDEO GAME OF CHANCE AND PLAYER CONTROLLED SUBSYSTEM THEREFOR

BACKGROUND OF THE INVENTION

This invention is related generally to video games, and more particularly to a remote control system for playing a game upon a color television receiver wherein a broadcast received by the receiver may be viewed interchangeably with the game, each without interference to the other.

Video games have increased in popularity ever since their inception nearly twenty years ago. Such games were initially stand-alone machines which were dedicated to the play of a single game. Video arcades sprung up to provide a greater selection of games which could be played. However, as their popularity grew and the state of the art of semiconductor technology improved, video games systems capable of being used with the family's television entered the marketplace.

Several problems arose as a result of the play-at-home video game revolution. Many systems were difficult to install as they required complicated cable connections to a conventional television set. As was often the case, the user's entertainment center included not only a conventional television set, but also a cable television channel selector, and a video cassette recorder. It was therefore apparent that careful and meticulous installation was necessary in order to interface each of such a plurality of entertainment means. Still other emotional problems were caused in a family situation where the children retained control of the video game and family television set. A means which would permit the children to play the video game, and yet give ultimate control of the television set to the parents would obviously be desirable.

Another more recent phenomena has arisen from the spread of casino gambling to Atlantic City. Millions of people from the East Coast annually flock to the New Jersey resort and spend billions of dollars in an ever growing number of casinos. Unlike their counterparts in Nevada, the Atlantic City resorts are primarily of the casino hotel type which permits a gambler to sleep in comfort at the hotel which houses his favorite casino. One drawback to such an arrangement, however, is that gambling is available only in the confines of the casino floor where security must be posted. This inconveniences the gambler who stays in a casino hotel by requiring him to play on the casino floor. If he instead wished to avoid the ever present throngs of people and play from his room, that option would be unavailable. A stand-alone video game which simulated various games of chance could be installed in each guest's room, but would be costly to the casino hotel. Furthermore, such an arrangement would be cumbersome for security purposes. It would, therefore, be desirable to provide a means by which a gambler could remain in his room at a casino hotel and still enjoy the opportunities provided by gambling.

SUMMARY OF THE INVENTION

Accordingly, it is a general purpose of the present invention to provide a remote control system for playing a game upon a color television receiver, wherein a broadcast received by the color television receiver may be viewed interchangeably with the game each without interference to the other.

Another object of the present invention is to provide a remote control system for such a color television receiver through which a gambler may wager bets on games such as video poker.

A further object of the present invention is to provide a video poker game capable of being viewed interchangeably upon a color television receiver installed in a guest's room of a casino hotel.

Still another object of the present invention is to provide a video poker game for a casino hotel in which a security means is provided to permit control by casino authorities.

Briefly, these and other objects of the present invention are accomplished by a remote control system for playing a game upon a color television receiver having red, green and blue video signal circuit means for driving at least one electron gun, means for amplifying an audio signal, means for generating a composite sync signal, and circuit means adapted to receive the composite sync signal for controlling a color picture tube, wherein a broadcast received by the color television receiver may be viewed interchangeably with the game, each without interference to the other.

In order to provide a more secure means of play, especially within the casino hotel environment, the remote control system includes a supervisory transmitter means for remotely transmitting a first signal to the television receiver having encoded thereon a first plurality of commands including a display command for selectively displaying the game or the broadcast, and player transmitting means for remotely transmitting a second signal to the color television receiver, the second signal having encoded thereon a second plurality of commands relating to the play of the game. A means for receiving the first and second encoded signals is provided, and coupled to a decoder means for decoding the signals and inputting them to a solid-state logic board having programmable means for simulating the game. The programmable means responds to the first and second plurality of commands, and outputs those responses in the form of a third plurality of commands to a transfer unit coupled to the color television receiver. The transfer unit thereafter bypasses the composite sync signal, and provides its own outputs to the video signal circuit means for driving the at least one electron gun in response to the third plurality of commands. In accordance with one important aspect of the invention, the player transmitting means is capable of playing the game, but the supervisory transmitter means controls the display of either the broadcast received by the color television receiver or the game. When the supervisory transmitter means selects via the display command to view the broadcast, after a game is in play, the transfer unit permits continuation of play by removing the bypass to the composite sync signal for purposes of viewing the broadcast, but does not affect the logic levels present in the solid-state logic board.

Other objects, advantages and novel features of the invention will becomes apparent from the following detailed description of the invention when considered in conjunction with the accompanying drawings:

DETAILED DESCRIPTION OF THE PREFERRED EMBODIMENT

Figure 1:
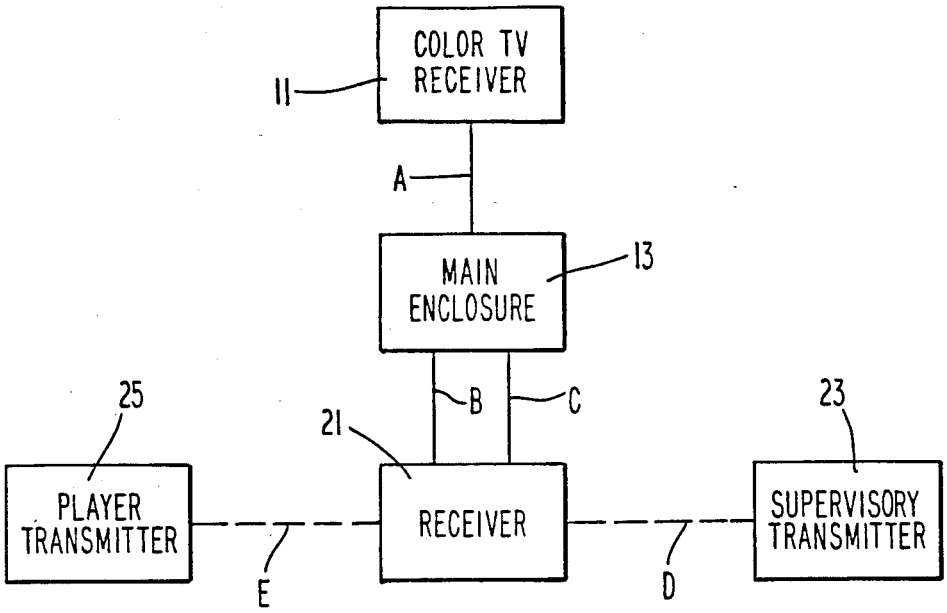
FIG. 1 is a block diagram of a remote control system according to the present invention.

Referring now to the drawings, wherein like characters represent like or corresponding parts throughout the several views, there is shown in FIG. 1 a simplified block diagram of the remote control system according to the present invention. A conventional color television receiver 11 receives a plurality of signals A from a main enclosure 13, including a power supply 15, a game board 17, and a decoder 19 as is described in more detail herein below with reference to FIG. 4. The main enclosure 13 receives a first and second plurality of command signals B and C received by a receiver 21 from a pair of remotely situated transmitters 23 and 25. In accordance with one important aspect of the present invention, one transmitter is selected as a supervisory transmitter 23 for remotely transmitting a plurality of encoded command signals D which include a DISPLAY command for selectively displaying the game played on the game board 17 or a broadcast received by the color television receiver 11. The other transmitter 25 permits a player to compete with the game played by the game board 17 as viewed on the color television receiver 11.

Figure 2:
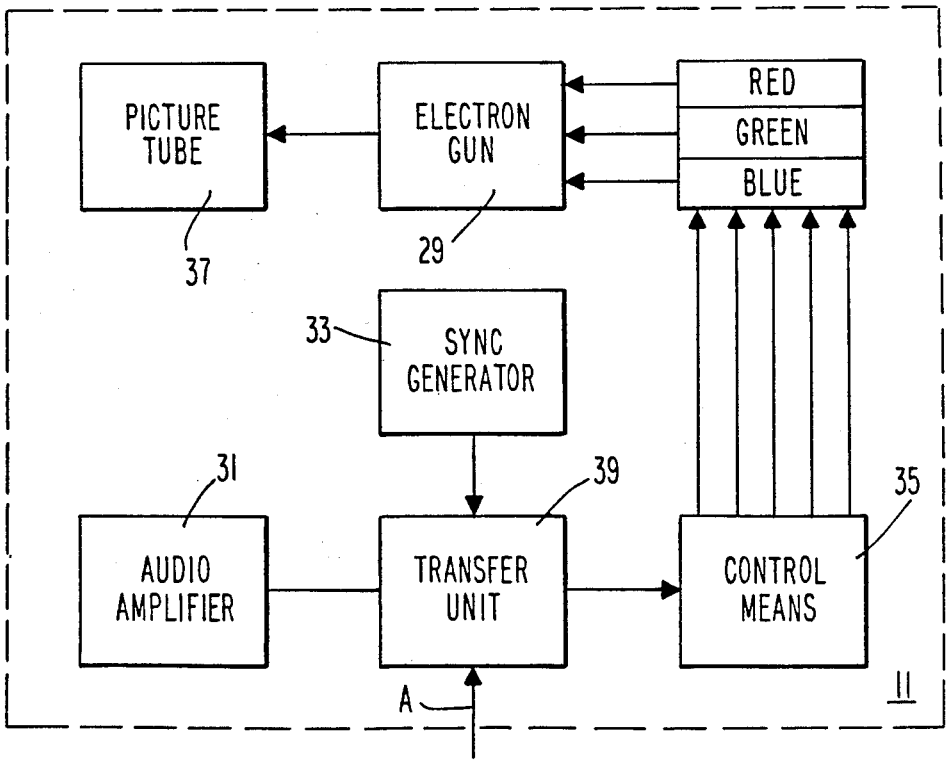
FIG. 2 is a detailed block diagram showing the color television receiver of FIG. 1.

As is shown more clearly in FIG. 2, the color television receiver 11 includes red, green and blue video signal circuit means 27*a*, 27*b* and 27*c* for driving at least one electron gun 29, means for amplifying an audio signal, such as a conventional audio amplifier 31, means for generating a composite sync signal, such as a sync generator 33, and circuit means 35 adapted to receive the composite sync signal for controlling a color picture tube 37.

In accordance with another important aspect of the invention, a transfer unit 39 is coupled to receive the plurality of command signals A and to bypass the composite sync signal produced by the sync generator 33. As will be explained in greater detail with reference to FIG. 3 herein below, the transfer unit 39 thus enables the remote control system to interchangeably control viewing of the broadcast received by the color television receiver 11 or the game played by the game board 17.

Figure 4:
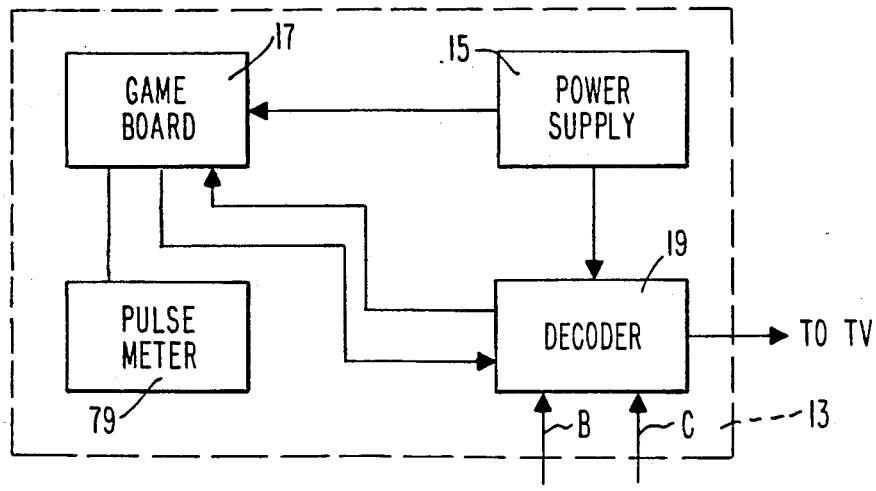
FIG. 4 is a detailed block diagram of the main enclosure shown in FIG. 1.

Referring now to FIG. 4, details of the main enclosure 13 will be disclosed. As discussed herein above, the main enclosure 13 houses the power supply 15, which provides power to the system in the form of +5 VCD, −5 VDC, +12 VDC and +12 VAC, the game board 17, and the decoder 19. The power supply 15 may also include a surge suppressor (not shown) for 120 VAC, and means for adjusting the 5 VDC supply. In a particularly preferred embodiment of the present invention, the game board 17 comprises a solid-state logic board capable of playing high-low double-up joker poker. One suitable such board is manufactured as Model II by SMS Manufacturing Corporation, Lakewood, NJ. An alternative board 17 is available from M. Kramer Manufacturing, Inc. as Model 3000. Both such boards have been used previously in stand-alone video poker games, and are thus well known in the art.

Figure 6:
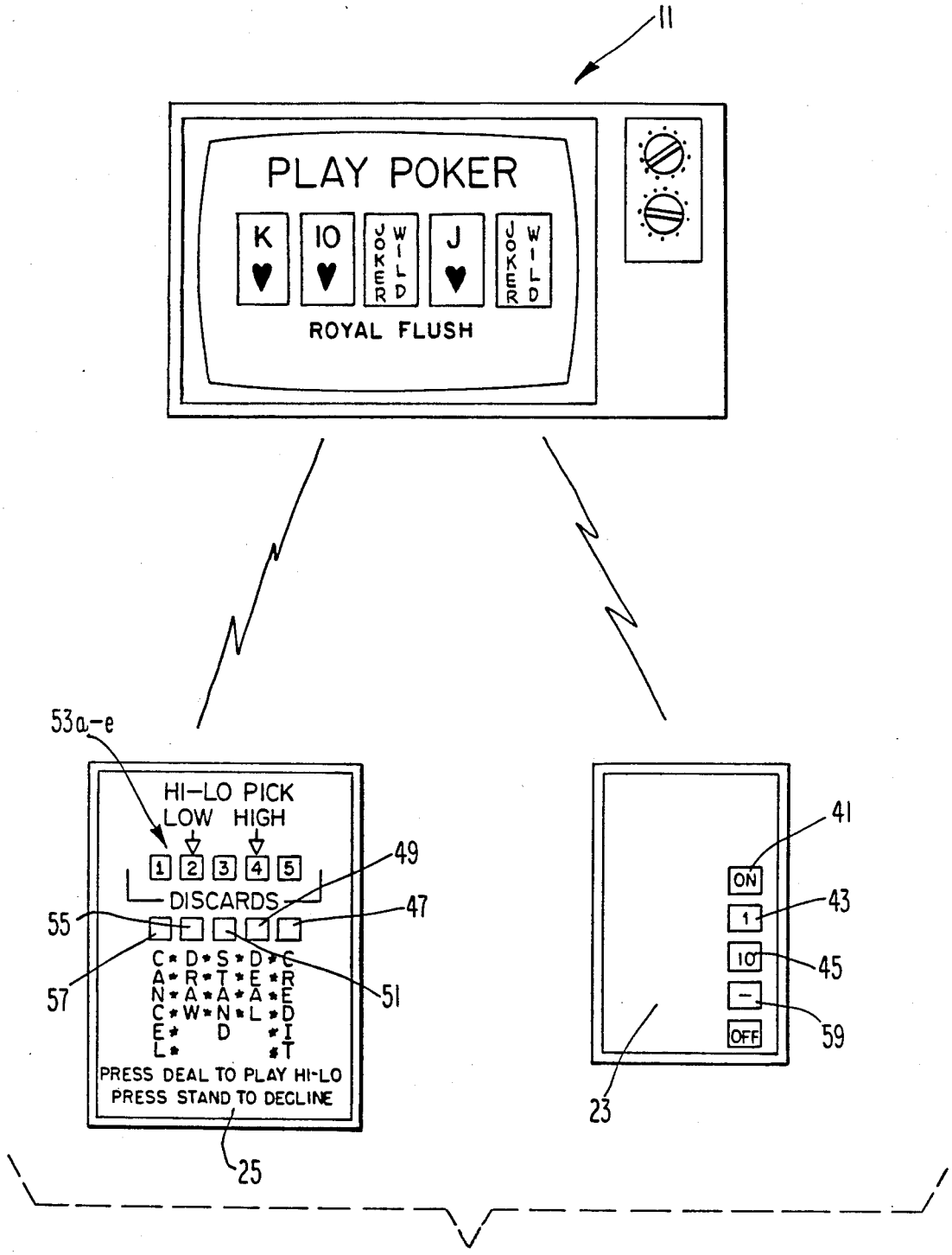
FIG. 6 illustrates play of the game with a supervisory transmitter and player transmitter in accordance with a preferred embodiment of the present invention.
Figure 7A:
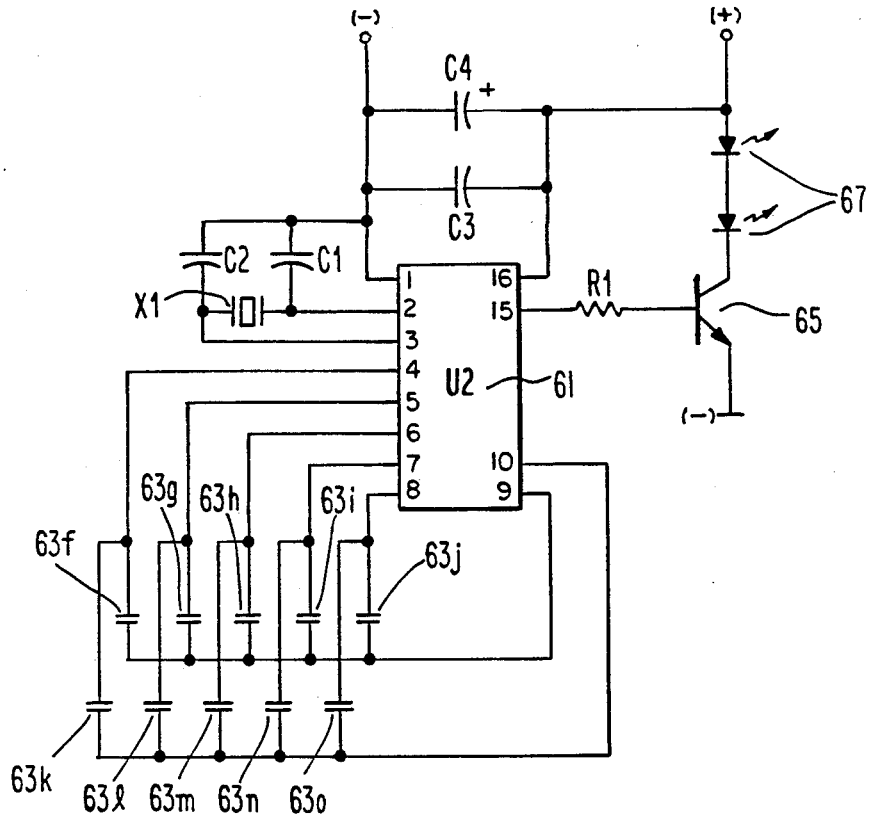
FIGS. 7A and 7B are schematic diagrams of the transmitters shown in FIG. 6.

The operation of the remote control system according to the present invention will be explained briefly with reference to FIGS. 6, 7*a* and 7*b*. Assuming the guest in a casino hotel desires to play video poker, he may call the front desk to activate the game. Using the supervisory transmitter 23, the front desk activates an ON button 41 to switch the guest's color television receiver 11 to the poker game. Depending upon the guest's financial status and the desirability of the casino hotel to extend credit, the operator at the front desk may then place credits for the player by pushing either a first button 43 or second button 45. For each depression of the first button 43, one credit is established in the player's name. Likewise, each depression of the second button 45 enters multiples of ten credits. Obviously, the second button 45 could be changed to other multiples which would permit easy crediting by the supervisor.

Once the ON button 41 has been depressed and either buttons 43 or 45 have been depressed to establish a player's line of credit, the player first decides how much he desires to bet and depresses a CREDIT button 47 on the player transmitter 25. A hand is then dealt by the player's depressing a DEAL button 49, whereupon five cards are displayed across the face of the color television receiver 11.

If the player is satisfied with hand dealt, he depresses a STAND button 41 to indicate a "pat hand". Otherwise, the player decides which of the cards displayed on the color television receiver 11 he wishes to discard, and indicates such to the game board 17 by depressing one of the five DISCARD buttons 53*a–e* which correspond to the displayed cards. Additional cards are then drawn after discarding by the player's depressing a DRAW button 55. If, before the player depresses the DRAW button 55, he becomes dissatisfied with a decision to discard, a single depression of a CANCEL button 57 will bring back the discards. Winnings are then determined by the game board 17 in accordance with established odds. The player may continue to play until his credit line is depleted, or request a cash out from the front desk. The operator at the front desk, accordingly, permits the player to take his winnings by pushing a CASH OUT button 49 on the supervisory transmitter 23. As a result, the credits won by the player are subsequently recorded in a conventional memory located on the game board 17.

Figure 7B:
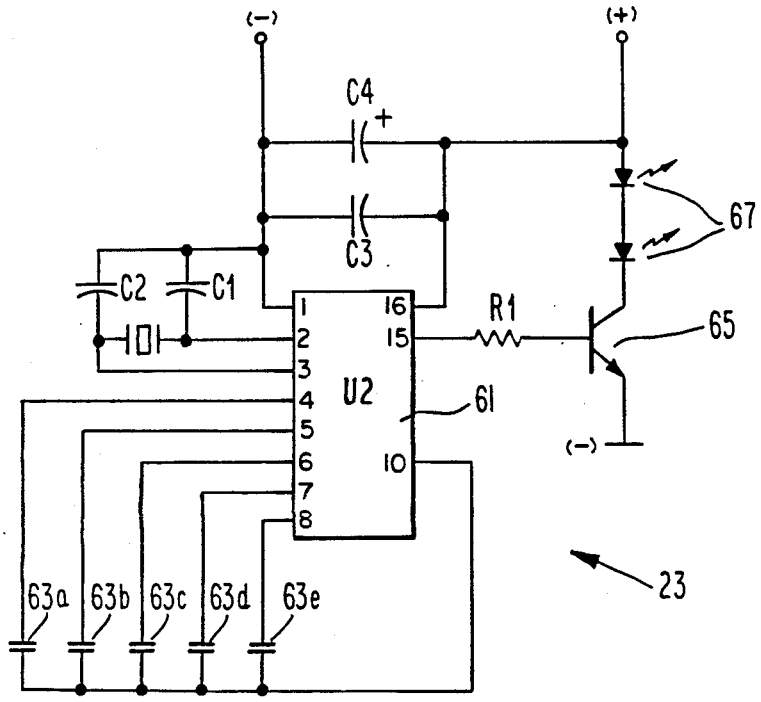

As shown in FIG. 7*b*, the supervisory transmitter 23 consists generally of a push button-controlled integrated circuit 61, an array of push buttons 63*a–e*, a transistor amplifier 65, and a pair of light emitting diodes 67*a* and 67*b*. The push buttons 63*a–e* correspond respectively to the ON button 41, CREDIT buttons 43 and 45, CASH OUT button 59, and an OFF button 69 which switches the poker game back to the television. In a similar manner, the player transmitter 25 as shown in FIG. 7*a* comprises a push button-controlled integrated circuit 61, push buttons 63*f–o* corresponding respectably to the DISCARD buttons 53*a–e*, CREDIT button 47, DEAL 49, stand button 51, draw button 55 and cancel button 57, transistor amplifier 65, and a pair of light emitting diodes 67*c* and 67*d*. Table I below indicates suitable values for the embodiment shown in FIGS. 7*a* and *b*.

TABLE I

| Component | Value |
|---|---|
| IC 61 (U2) | M50110-CP |
| Push buttons 63a–o | 87 GC3-201 |
| Transistor amplifier 65 | D 42 C3 |
| LED 67 | TIL38 |
| R1 | 330 ohmns |
| C1, C2 | 100 pf |
| C3 | 0.01 mf |
| C4 | 470 mf |
| X1 | CSB455C |

Referring again to FIGS. 1 and 3, when considered in conjunction with the foregoing description of playing the game, the operation of the remote control system will be described. In a particularly preferred embodiment of the present invention, the light emitting diodes 67 and receiver 21 are adapted to send and receive modulated infrared signals in the form of a "missing pulse code". That is, when the ON button 41 on the supervisory transmitter 23 is depressed, a first plurality of commands are transmitted through the receiver 21 to the decoder 19 from the supervisory transmitter 23. A second plurality commands, also in the "missing pulse code" format and indicative of the player's selection, are transmitted from the player transmitter 25 through the receiver 21 to the decoder 19. According to the "missing pulse code", each time a push button 63*a–o* is depressed, an encoded signal is sent with the first few pulses permitting the circuits contained in the game board 17 to gain adjust. Thereafter, the decoder 19 receives an encoded signal in binary form with the missing pulses indicating a particular selection defined by the push buttons 63*a–o*. Once decoded in a conventional manner by the decoder 19, those signals are forwarded to the game board 17 for use therein, the game board 17 producing a third plurality of signals (indicated by A in FIG. 1) which are sent to the transfer unit 39 (FIG. 2 and 3) for use in controlling the color television receiver 11.

Figure 3:
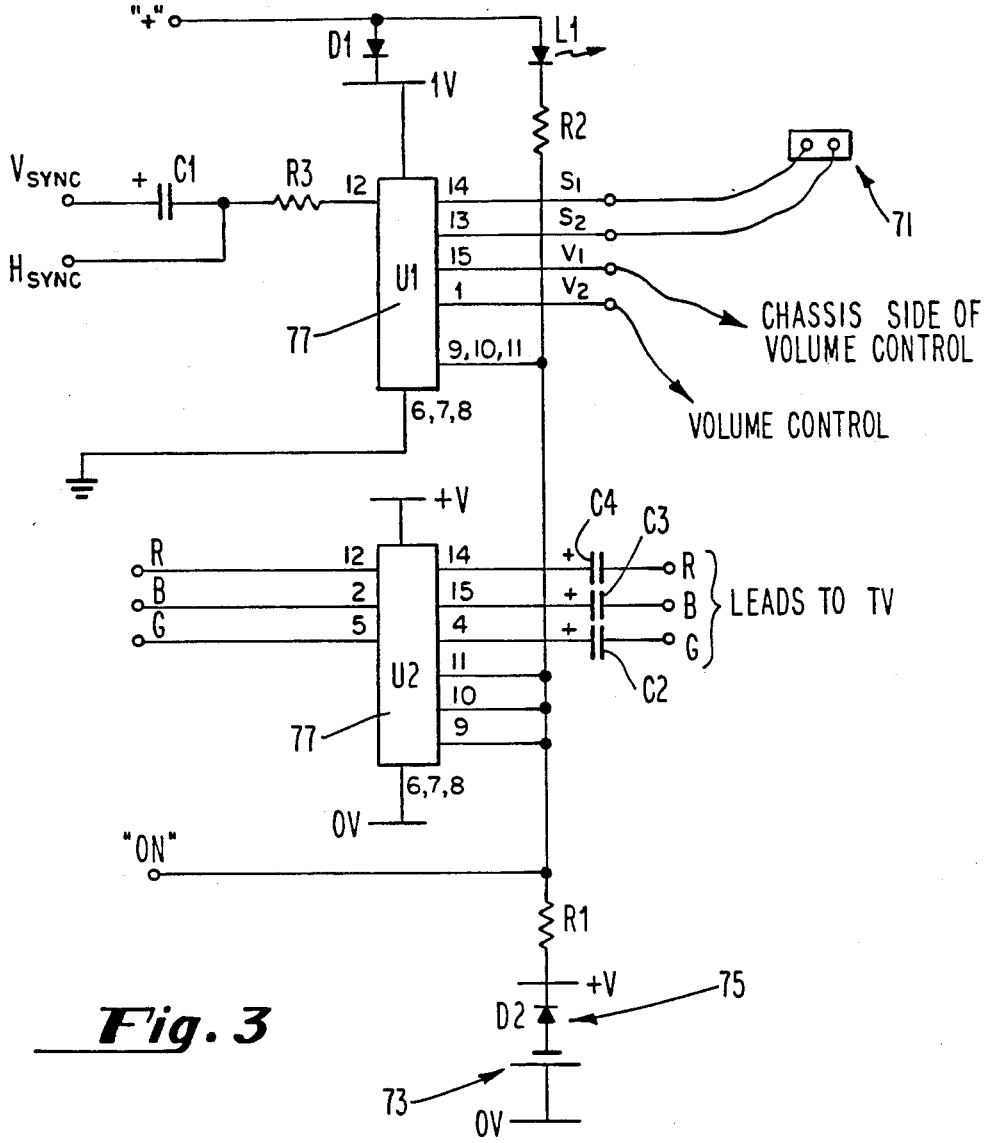
FIG. 3 is a schematic diagram of the transfer unit shown in FIG. 2.
Figure 5:
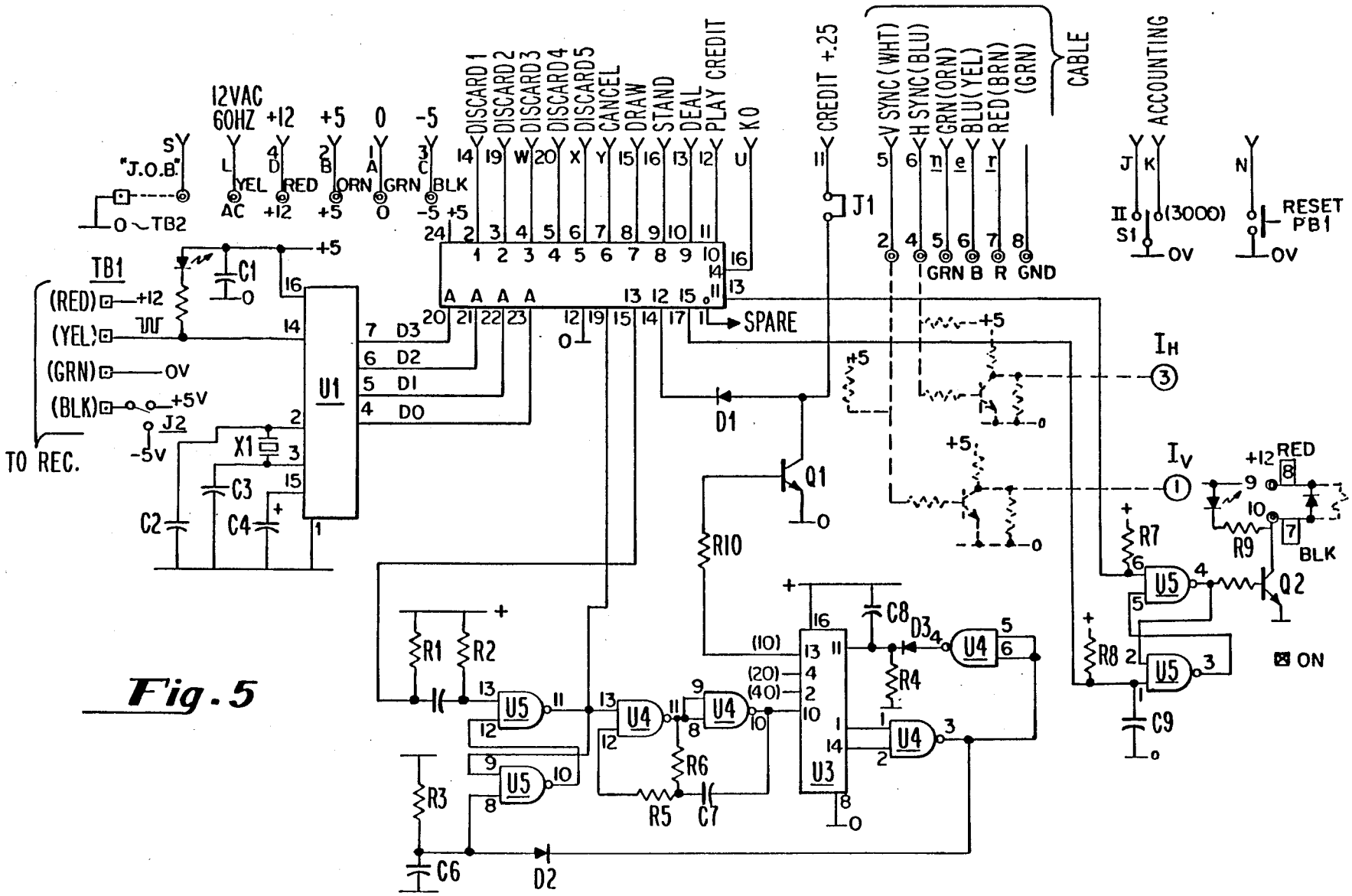
FIG. 5 is a schematic diagram of the decoder shown in FIG. 4.

The transfer unit 39, as shown in FIG. 3, receives the third plurality of signals A including a vertical sync signal, a horizontal sync signal, both produced by the game board 17, and signals to control the red, green and blue colors, as well as one signal to change the display on the color television receiver 11 from the broadcast to the poker game. The transfer unit 39 also contains a jumper plug 71 which bypasses the composite sync signal in order that the transfer unit 39 may control the scan of the picture tube 37 with the horizontal and vertical sync signals provided from the game board 17. Attenuation of the audio signal is also achieved by suppressing the signal to the audio amplifier 31 from leads $V_1$ and $V_2$ shown in FIG. 3. When the ON button 41 is depressed to activate the game, a battery 73 forward biasses a diode 75, thus biassing a pair of integrated circuits 77 for control of the red, green and blue video signals from the transfer unit to the picture tube 37. A schematic of the preferred decoder 19, with appropriate circuit elements noted therein, is shown in FIG. 5.

Obviously, many modifications and variations of the present invention are possible in light of the above teachings. For example, the supervisory transmitter 23 may be situated as a control box on top of the color television receiver 11 in the guest's room. This would enable the guest to control whether the game or the television was to be displayed, and would permit him to cash out when desired. However, it should be noted that in such event and in order to provide the security necessary in a casino hotel environment, the CREDIT buttons 43 and 45 could alternately be actuated by a room service employee with suitable and conventional card actuation. Moreover, an accounting means, such as a mechanical pulse meter 79 (FIG. 4), could be included within the main enclosure 13 in order to backup the auditing of bets placed which is conventionally carried out within the game board 17. Otherwise, the mechanical pulse meter used as the accounting means could be placed at the front desk of a casino hotel to monitor the guest's credit line. It is therefore to be understood that within the scope of the appended claims, the invention may be practiced otherwise than as specifically described.

What is claimed is:

1. A remote control system for playing a game upon a color television receiver having red, green and blue video signal circuit means for driving at least one electron gun, means for amplifying an audio signal, means for generating a composite sync signal, and circuit means receiving the composite sync signal for controlling a color picture tube with at least a horizontal sync signal and a vertical sync signal, wherein a broadcast received by the color television receiver may be viewed interchangeably with the game, each without interference to the other, said remote control system comprising:

supervisory transmitter means for remotely transmitting a first signal having encoded thereon a first plurality of commands including a display command for selectively displaying the game or the broadcast;

player transmitter means for remotely transmitting a second signal having encoded thereon a second plurality of commands;

wherein said first and second signals comprise infrared signals;

means for receiving said first and second encoded signals;

a main enclosure, including a power supply, a solid-state logic board having programmable means for simulating the game in response to said first and second plurality of commands, and means coupled between said receiving means and said logic board for decoding said first and second encoded signals to produce said first and second plurality of commands; and a transfer unit coupled between said main enclosure and the circuit means for controlling the color picture tube, said transfer unit being adapted to bypass the composite sync signal and further coupled to the video signal circuit means for driving the at least one electron gun in response to a third plurality of commands produced by said logic board responding to said first and second plurality of commands;

wherein said supervisory transmitter means and said player transmitter means each comprise:

a plurality of push buttons for respectively selecting said first and second plurality of commands;

integrated circuit means coupled to said plurality of push buttons for respectively outputting said first and second plurality of commands;

a transistor amplifier coupled to receive the commands output from said integrated circuit means; and a pair of light emitting diodes coupled to said transistor amplifier and adapted to emit infrared light in response to said first and second plurality of commands.

2. The remote control system according to claim 1, wherein said receiving means is adapted to receive an infrared signal.

3. A remote control system for playing an interactive game of chance upon a color television receiver having red, green and blue video signal circuit means for driving at least one electron gun, means for amplifying an audio signal, means for generating a composite sync signal, and circuit means for receiving the composite sync signal for controlling a color picture tube with at least a horizontal sync signal and a vertical sync signal, wherein a broadcast received by the color television receiver may be viewed interchangeably with the interactive game, each without interference to the other, said remote control system comprising:

supervisory transmitter means for remotely transmitting a first signal having encoded thereon a first plurality of commands including a display command for selectively displaying the interactive game or the broadcast and a cash out command for cashing out winnings taken by a player;

player transmitter means for remotely transmitting a second signal having encoded thereon a second plurality of commands which enable said player to selectively play the interactive game;

means for receiving said first and second encoded signal;

a main enclosure, including a power supply, a solid-state logic board having programmable means for simulating the interactive game in response to said first and second plurality of commands, and means coupled between said receiving means and said logic board for decoding said first and second encoded signals to produce said first and second plurality of commands; and a transfer unit coupled between said main enclosure and the circuit means for controlling the color picture tube, said transfer unit being adapted to bypass the composite sync signal and further coupled to the video signal circuit for driving the at least one electron gun in response to a third plurality of commands produced by said logic board responding to said first and second plurality of commands, said third plurality of commands including commands which enable said logic board to play the interactive game based upon the selections of said player;

wherein said supervisory transmitter means and said player transmitter means each comprise:

a plurality of push buttons for respectively selecting said first and second plurality of commands;

integrated circuit means coupled to said plurality of push buttons for respectively outputting said first and second plurality of commands;

a transistor amplified coupled to receive the commands output from said integrated circuit means; and a pair of light emitting diodes coupled to said transistor amplifier and adapted to emit infrared light in response to said first and second plurality of commands.

* * * * *